US011421842B2

(12) United States Patent
Arlinghaus et al.

(10) Patent No.: US 11,421,842 B2
(45) Date of Patent: Aug. 23, 2022

(54) LIGHTING UNIT FOR A MOTOR VEHICLE HEADLIGHT FOR GENERATING A LIGHT DISTRIBUTION HAVING A LIGHT-DARK BOUNDARY

(71) Applicants: ZKW Group GmbH, Wieselburg (AT); Bayerische Motoren Werke Aktiengesellschaft, Munich (DE)

(72) Inventors: Stephan Arlinghaus, Oberkochen (DE); Helmut Erdl, Flintsbach (DE)

(73) Assignees: ZKW Group GmbH, Wieselburg (AT); Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/295,506

(22) PCT Filed: Nov. 21, 2019

(86) PCT No.: PCT/EP2019/082053
§ 371 (c)(1),
(2) Date: May 20, 2021

(87) PCT Pub. No.: WO2020/104576
PCT Pub. Date: May 28, 2020

(65) Prior Publication Data

US 2022/0010938 A1 Jan. 13, 2022

(30) Foreign Application Priority Data

Nov. 22, 2018 (EP) ..... 18207781

(51) Int. Cl.
*F21S 41/147* (2018.01)
*F21S 41/365* (2018.01)
(Continued)

(52) U.S. Cl.
CPC ..... *F21S 41/147* (2018.01); *F21S 41/322* (2018.01); *F21S 41/365* (2018.01); *F21W 2102/165* (2018.01); *F21Y 2115/10* (2016.08)

(58) Field of Classification Search
CPC ..... F21S 41/147; F21S 41/365
See application file for complete search history.

(56) References Cited

U.S. PATENT DOCUMENTS

2006/0007544 A1* 1/2006 Suzuki ..... F21V 9/04 359/533
2009/0284981 A1 11/2009 Kazunori

FOREIGN PATENT DOCUMENTS

JP H01220301 A 9/1989
JP 2000348508 A 12/2000
(Continued)

OTHER PUBLICATIONS

International Search Report for Application No. PCT/EP2019/082053, dated Jan. 31, 2020. (13 pages).

*Primary Examiner* — Karabi Guharay
(74) *Attorney, Agent, or Firm* — Eversheds Sutherland (US) LLP

(57) ABSTRACT

The invention relates to a lighting unit for a motor vehicle headlight for generating a light distribution having a light-dark boundary, wherein the lighting unit (1) comprises a light source (2), a first reflector ($R_1$) having at least one focal point ($F_{1R1}$) in which the light source (2) is arranged, a second reflector ($R_2$) having at least one focal point ($F_{1R2}$), wherein the second reflector ($R_2$) is arranged downstream of the first reflector ($R_1$) in the beam path (S), and an aperture (B) arranged between the first reflector ($R_1$) and the second reflector ($R_2$). The first reflector ($R_1$) has a first reflector portion ($R_{11}$) and at least one second reflector portion ($R_{12}$), the aperture (B) being arranged in such a way that it is associated with the first reflector portion ($R_{11}$) of the first
(Continued)

reflector ($R_1$) and is arranged at a small distance ($D_1$) near the beam ($S_{11}$) emitted from the first reflector portion ($R_{11}$), and clips the intermediate light image generated in the first reflector portion ($R_{11}$) to form a light-dark boundary, and the intermediate light image generated in the second reflector portion ($R_{12}$) is substantially free of influence of shadowing of the aperture arrangement.

19 Claims, 7 Drawing Sheets

(51) Int. Cl.

| | |
|---|---|
| ***F21S 41/32*** | (2018.01) |
| *F21Y 115/10* | (2016.01) |
| *F21W 102/165* | (2018.01) |

(56) References Cited

FOREIGN PATENT DOCUMENTS

| | | | |
|---|---|---|---|
| JP | 2002313112 | A | 10/2002 |
| JP | 2007080637 | A | 3/2007 |
| JP | 4145526 | B2 | 9/2008 |

* cited by examiner

LIGHTING UNIT FOR A MOTOR VEHICLE HEADLIGHT FOR GENERATING A LIGHT DISTRIBUTION HAVING A LIGHT-DARK BOUNDARY

The invention relates to a lighting unit for a motor vehicle headlight for generating a light distribution with a light-dark boundary, the lighting unit, comprising at least one light source, at least one first reflector having at least one focal point, wherein the at least one light source is arranged in the at least one focal point, and the at least one first reflector is configured to emit and forward light to a second reflector, at least one second reflector having at least one focal point, wherein the at least one second reflector is arranged downstream of the at least one first reflector in the beam path and is configured to display an intermediate light image generated by the first reflector, and at least one aperture which is arranged in the beam path between the at least one first reflector and the at least second reflector.

Furthermore, in the scope of the invention, a motor vehicle headlight having at least one lighting unit according to the invention is also specified.

Numerous embodiments of lighting units for a motor vehicle headlight for generating a light distribution with a light-dark boundary are already known from the prior art. The creation of a defined light-dark boundary in the light image of a motor vehicle headlight is either required by law—for example, a low beam with a horizontal light-dark boundary is mentioned—or such a light-dark boundary is desired by vehicle manufacturers as a defined additional light function of the corresponding motor vehicle headlights. For example, the light functions of glare-free high beam or adaptive driving light, which can usually be ordered as special equipment when buying a new car, should be mentioned. In this case, light-dark boundaries are required in a vertical, horizontal, or combined form. Technically, light-dark boundaries in lighting units for motor vehicle headlights are implemented either by direct imaging of sufficiently large gradients of the illuminance of the light source or—if the light source used does not have such gradients—are artificially generated by introducing appropriate apertures into the beam path of the lighting unit. The correspondingly produced intermediate light images then have regions which are clipped or darkened by one or more apertures and which are imaged with the aid of lenses or reflectors as a light distribution in front of the road in front of the motor vehicle headlight. The disadvantage of using such apertures to create light-dark boundaries, however, always results in undesirable losses in the luminous flux of the lighting unit or the motor vehicle headlight and thus to an overall reduced efficiency of the lighting system, the efficiency being determined as the quotient of the used luminous flux to the exiting luminous flux (in each case specified in lumen [lm]).

This problem arises in particular in the case of lighting units that are intended to generate a wide light distribution perpendicular to the light-dark boundary. This is the case, for example, when a broad horizontal light image with a vertical light-dark boundary is to be generated. Obviously, this is also true for lighting units with which a light pattern, which is high in the vertical direction and has a horizontal light-dark boundary, is to be generated.

For those cases in which the design of the light source does not allow the creation of a vertical light-dark boundary by direct imaging of the light source, for example, since the requirements for the width of the light distribution or the quality of the light-dark boundary cannot be met, a corresponding light-dark boundary can be generated by introducing an aperture into the beam path. Since the desired light patterns are often limited to small angular ranges or high illuminance levels are required, if the emitter has wide radiation cones—as can be the case, for example, when using LED light sources or laser light sources—focusing in the region of the beam aperture is required. An optics arrangement of this type therefore requires in any case a light source as an emitter, a first reflector that concentrates the light from the light source or the emitter on a focal point, an aperture that shadows part of the light, and a second reflector that images the intermediate light image generated in the focal plane of the focal point.

In the event that the first reflector has only one focal point, the entire intermediate light image in the focal plane is formed by the aperture or is clipped by the aperture. Since the desired light image generated by the motor vehicle headlight usually not only has a light-dark boundary but also has to meet defined requirements, for example with regard to its light image width in the front of the road, it is usually not sufficient for homogeneously radiating light sources or emitters to depict the intermediate image directly, but rather the image must be widened accordingly with a second reflector. In order to avoid an undesirable softening of the light-dark boundary, i.e. a reduction in the gradient of the light-dark transition, the second reflector can be subdivided or faceted into a plurality of facets, each of the facets shifting the part of the intermediate light image generated by it somewhat in the horizontal direction. The sum of the individual facet images then results in the entire light image of the motor vehicle headlight. The disadvantage of such an arrangement, however, is that the aperture for generating the light-dark boundary is effective in each individual one of the facet images, and not only in an outer or in the outermost of the facet images, where the use of the aperture for generating the light-dark boundary is actually needed. This disadvantageously reduces the luminous flux of the motor vehicle headlight, which also reduces its overall efficiency.

The object of the present invention is therefore to avoid the disadvantages known from the prior art for lighting units of the type mentioned at the outset, to reduce the losses in the luminous flux of the lighting unit caused by the aperture, and to increase the efficiency of the lighting unit.

According to the invention, this object is achieved in a generic lighting unit according to the preamble of claim 1 with the features of the characterizing part of claim 1. Particularly preferred embodiments and developments of the invention are the subject of the dependent claims.

In a generic lighting unit for a motor vehicle headlight for generating a light distribution with a light-dark boundary the first reflector is constructed in at least two parts and has a first reflector portion and at least one separate second reflector portion, each reflector portion having at least one focal point in each case, and at least one focal point of the first and the at least second reflector portion is arranged in each case congruently at the location of the at least one light source, the at least two part first reflector splits the beam exiting from the at least one light source into at least two separate beams, and the at least one aperture is arranged in such a way that it is associated with the first reflector portion of the first reflector and is arranged at a small distance near the beam emitted from the first reflector portion, and clips the intermediate light image generated in the first reflector portion to form a light-dark boundary, and the at least one aperture is arranged at a greater distance away from the beam emitted from the at least second reflector portion and the intermediate light image generated in the second reflector portion is substantially free of influence of shadowing of the aperture arrangement.

By dividing the first reflector into at least two reflector portions, each having at least one dedicated focal point, the exiting beam is split into at least two separate beams. By appropriately arranging the at least one aperture in the beam path, it is possible to assign the aperture to a specific, first reflector portion of the first reflector in which the generation of a partially clipped or partially shadowed intermediate light image to form a light-dark boundary is required and desired. This is achieved by a corresponding arrangement of the aperture at a small distance near the first beam emitted from this first reflector portion.

From the at least second reflector portion and the second beam emitted therefrom, however, said at least one aperture is spaced at a comparatively significantly greater distance than the small distance set between said aperture and the first beam of the first reflector portion. This makes it possible to clip only the intermediate light image generated in the first reflector portion with the aperture to form a light-dark boundary, but not the intermediate light image generated in at least the second reflector portion, for which, due to the comparatively larger distance between the emitted second beam and the aperture, the aperture edge thereof is not suitable for forming a light-dark boundary. The intermediate image generated at least in the second reflector portion thus remains substantially free of influence of shadowing of the aperture arrangement.

The invention also includes embodiments of a lighting unit in which the first reflector is subdivided into three or more reflector portions, for example, as well as embodiments in which one or more apertures are associated with individual reflector portions. In these cases too, the losses in the luminous flux of the lighting unit caused by the aperture are advantageously minimized and the overall efficiency of the lighting unit is increased if at least one of the three or more reflector portions is substantially free of influence of shadowing of the aperture arrangement.

The at least two or more separate reflector portions of the first reflector can, for example, be made in one piece, with a transition region being formed between adjoining reflector portions, for example in the form of a curve or a line. As an alternative to this, individual or all of the reflector portions of the first reflector can also consist of one or more individual components and the first reflector can thus be produced in multiple pieces from a plurality of assembled components.

According to the definition, an intermediate light image generated in the aperture plane is then categorized as "substantially free of influence of shadowing of the aperture" if the luminous flux of the intermediate light image in question is not or only slightly reduced by introducing the aperture into the beam path and thus no functional light-dark boundary is achieved with such an aperture arrangement.

The ordinal numbers used in this case and below to uniquely designate a first, second, or third reflector portion of the first reflector or a first, second, or third reflector segment of the second reflector are only intended to improve understanding and simplify readability. Due to the selected ordinal numbers, the relevant individual reflector portions or reflector segments are, however, neither ranked in the sense of a rating, nor are their location, position, or alignment fixed with respect to one another.

For example, in a lighting unit with four reflector portions into which the first reflector is divided, a first aperture can be associated with the first reflector portion and a second aperture can be associated with the third reflector portion of the first reflector and said apertures are arranged in each case at a short distance near the beam emitted from the first reflector portion or from the third reflector portion, wherein the intermediate light images generated in the first and in the third reflector portion are clipped in each case to form corresponding light-dark boundaries. In this example, the second and fourth reflector portions are in each case substantially free of influence of shadowing by the aperture arrangements. Depending on the requirements of the motor vehicle headlight, the multiple reflector portions can be positioned here with regard to their installation positions, for example, in a row, substantially in the horizontal direction next to one another, in columns, substantially in a vertical direction, one below the other, or in any desired matrix arrangement.

In a lighting unit according to the invention, the first reflector can particularly advantageously be constructed in a plurality of parts and have a plurality of reflector portions having at least one focal point and the at least one light source can be arranged in each case in the at least one focal point, the at least one aperture being arranged in such a way that it is associated exclusively with the first reflector portion of the first reflector and is arranged at a small distance near the beam emitted from the first reflector portion, and clips the intermediate light image generated in the first reflector portion to form a light-dark boundary, and the at least one aperture being arranged at a greater distance away from the beams emitted from the second and optionally from the further reflector portions of the first reflector at a distance, and the intermediate light images generated in the second and optionally the further reflector portions being substantially free of influence of shadowing of the aperture arrangement.

Thus, according to the invention, by suitable arrangement of the at least one aperture, the aperture-related losses in the luminous flux of the lighting unit can be further minimized and the efficiency of the lighting unit can advantageously be increased further.

These advantages also apply, for example, to the embodiment in which a plurality of apertures are arranged in the beam path between the first and the second reflector. In this case, too, by appropriately assigning the multiple apertures exclusively to the first reflector portion and away from the at least second reflector portion and possibly the further reflector portions, these can be positioned so that the intermediate image generated at least in the second reflector portion and, if applicable, the intermediate light images generated in one or more further reflector portions are in each case substantially free of influence of shadowing of the aperture arrangement.

In a lighting unit according to the invention, the second reflector is particularly expediently divided into two or more reflector segments in a facet-like manner, a first reflector segment of the second reflector being associated with the intermediate light image generated in the first reflector portion of the first reflector.

In this embodiment, the transitions between the reflector portions of the first reflector fall on transitions between the reflector segments of the second reflector or the transitions between the reflector portions and the reflector segments are also associated with one another. The proportion of undesired scattered light can therefore advantageously be reduced.

In a further preferred embodiment of the invention, in a lighting unit, the second reflector is divided into two or more reflector segments in a facet-like manner, precisely the first reflector segment of the second reflector being associated with the intermediate light image generated in the first reflector portion of the first reflector.

In this embodiment, only the facet image of the first reflector segment of the second reflector is advantageously clipped; the remaining reflector segments each provide a complete image of the light source used. The division of the first reflector is matched to the faceting of the second reflector in such a way that the light focused on the first reflector portion only hits the first reflector segment. This embodiment also offers the advantage that the proportion of undesired scattered light can be reduced.

In one embodiment variant of the invention, a lighting unit can advantageously be constructed in such a way that the at least one aperture is attached directly to or at least near the first reflector portion of the first reflector.

Attaching the aperture to the first reflector in this way can contribute to a higher mechanical stability of the aperture, the positioning accuracy of the at least one aperture to one or more focal points being increased and the tolerance chain of the positioning inaccuracy of the at least one aperture being reduced. This compact design advantageously allows the tolerances of the at least one aperture be reduced. The term "tolerance chain" used in this case is understood in the sense of tolerances with regard to fluctuations, the positioning, and the stability of the aperture.

According to an alternative embodiment, it can also be advantageous if, in a lighting unit according to the invention, the at least one aperture is attached directly on or at least near the first reflector segment of the second reflector.

This compact design, according to which the aperture is connected to the second reflector or is at least fastened near the first reflector segment of the second reflector, can advantageously reduce the tolerances of the aperture.

In a particularly preferred embodiment of the invention, in a lighting unit, an aperture plane of the at least one aperture can correspond to a focal plane of the at least one focal point of the first reflector segment of the second reflector.

When the aperture plane and the focal plane coincide, there is advantageously a sharp light-dark boundary with a large gradient of the light-dark transition not only near the focal point, but also at a specific distance therefrom.

Within the scope of the invention, it is also conceivable to arrange the at least one aperture in such a way that an aperture plane of the at least one aperture and a focal plane of the at least one focal point of the first reflector segment of the second reflector only intersect in a line through this focal point. In one embodiment of this type, a sharp light-dark boundary can only be deliberately achieved in the vicinity of the focal point, an aperture edge away from the focal point being imaged blurred; i.e. with a smaller gradient of the light-dark transition. Designs of this type with light-dark lines which are sharp only in parts or in regions can also be favorable and desirable for applications in the automotive industry.

In one advantageous development of the invention, in the case of a lighting unit, at least the first reflector portion of the first reflector can be an ellipsoidal reflector, which ellipsoidal reflector has a second focal point, the at least one aperture being arranged so that it is spaced by a short distance from the second focal point of the first reflector portion.

In this embodiment, point-like light sources can advantageously be imaged as points. Furthermore, the design of a reflector whose surface is an ellipsoid of revolution also offers advantages in terms of manufacturing technology. From a photometric point of view, the use of an ellipsoidal reflector of this type can possibly avoid undesirable distortions in the imaging of the light source in the focal plane.

In a lighting unit according to the invention, the two or more reflector portions of the first reflector can expediently each be ellipsoidal reflectors, the ellipsoidal reflectors having a second focal point in each case and the at least one aperture being arranged such that it is arranged at a small distance near the second focal point of the first reflector portion, and the aperture being arranged at a greater distance away from the second focal points of all further reflector portions of the first reflector.

It can also be particularly expedient if, in a lighting unit according to the invention, the small distance from the beam and/or from the second focal point of the first reflector portion of the first reflector to an aperture edge of the aperture can then be defined as being near the aperture, if the distance is less than 1.7 times the value of a reference length, preferably less than 1.5 times the value of a reference length, particularly preferably less than 1.3 times the value of a reference length, and the intermediate light image generated in the first reflector portion is clipped to form a light-dark boundary, the reference length being selected as the smallest distance from the distances of the maximum illuminance of all reflector portions of the first reflector to the aperture edge of the aperture.

Expediently, the reference length L, which can be used to assess or categorize the distance between the beam and the aperture and/or in the case of an ellipsoid reflector between the second focal point of the first reflector portion of the first reflector and the aperture, is determined as follows:

For all reflector portions $R_{11}$, $R_{12}$, $R_{1N}$ of the first reflector, the distance between the maximum of the illuminance $E_{MAX}$ and the aperture edge of the aperture is measured;

the smallest of these measured distances is selected as the reference length L.

The distance of that beam from the aperture, which beam is emitted from the first reflector portion of the first reflector for which the aperture is effective, is thus defined as near the aperture or near the aperture edge precisely then, when the distance is less than the 1.7 times the value, preferably less than 1.5 times the value, particularly preferably less than 1.3 times the value, of the previously defined reference length, provided that the intermediate light image generated in the first reflector portion is clipped also to form a light-dark boundary.

The maximum illuminance $E_{MAX}$ can be measured, for example, by a luminance camera, which records an image of the intermediate light image in the aperture plane, which image is made visible, for example, by introducing a matt plane into the aperture plane. Another possibility for measuring the maximum of the illuminance $E_{MAX}$ offers the introduction of a mirror or further optics into the beam path or into the aperture plane in order to measure the intermediate light image with a luminance camera or some other sensor system.

If the lighting unit is designed with an ellipsoidal reflector as the first reflector, the distance between the second focal point of the first reflector portion of the first reflector and the aperture or the aperture edge is expediently used for the same categorization. A calculation scheme is thus advantageously specified to determine which conditions an aperture arrangement must meet in order to be selectively associated with a first reflector portion of the first reflector and to be suitable for forming a light-dark boundary for the corresponding intermediate light image.

If the conditions set out above are not met, by definition the distance between a beam and/or a second focal point of the corresponding reflector portion of the first reflector is away from the aperture or from its aperture edge and the aperture arrangement is substantially free of shadowing influences on the intermediate light image generated in this reflector portion.

It can also be advantageous if, in a lighting unit according to the invention, the greater distance from the beam and/or from the second focal point of the second reflector portion and possibly the further reflector portions of the first reflector to an aperture edge of the aperture is then defined as away from the aperture, if by introducing the aperture in the beam path the luminous flux of the intermediate light image generated in the second and optionally the further reflector portions is reduced by at most 10%, preferably by at most 7%, particularly preferably by at most 5%.

According to the definition, an intermediate light image is substantially free of influence of shadowing of the aperture arrangement if the shape of the intermediate light image generated does not change or changes only insignificantly as soon as the corresponding aperture is completely removed from the beam path. This is the case when the luminous flux reduction caused by the aperture fulfills the values given above of at most 10%, preferably by at most 7%, particularly preferably by at most 5%. Minor interferences, according to which, under certain circumstances, for example, small edge regions of the intermediate light image generated can be shadowed without, however, being perceived as a functional light-dark boundary, do not represent, by definition, any significant shadowing or impairment of the corresponding intermediate light image.

In one advantageous development of the invention, in the case of a lighting unit, the at least one aperture can have a first aperture edge for generating a first light-dark boundary and a second aperture edge for generating a second light-dark boundary and/or can be adjustably arranged in the beam path between the at least one first reflector and the at least second reflector.

For example, it is conceivable within the scope of the invention to implement a lighting unit in which the at least one aperture is substantially L-shaped, with each of the two legs of this L-shaped aperture acting as an aperture edge with which each light-dark boundary can be generated in one case, for example, a horizontal and a vertical light-dark boundary. If the first reflector was divided into three, it would also be possible in such a case to assign the first aperture edge of the aperture to a first reflector portion of the first reflector and the second aperture edge of the aperture to a further second reflector portion of the first reflector by means of suitable aperture arrangement. In this case, the third reflector portion can be distanced so far from the two aperture edges that the intermediate light image generated in this reflector portion is in turn free of influence of shadowing of the aperture arrangement. This increases the luminous flux yield in a favorable manner.

It can also be provided within the scope of the invention to design a lighting unit with at least one aperture which is substantially V-shaped or in which three aperture edges are arranged in a triangular shape and the aperture edges form the sides of the triangular aperture recess. For example, in such a case, two aperture edges can be optically active and the third aperture edge can be arranged in such a way that it is not optically active.

In the case of one or more adjustable aperture edges, inaccuracies in the positioning of the aperture can advantageously be compensated for, as a result of which the robustness of such a lighting unit can be further increased.

In a particularly compact embodiment, the at least one light source in a lighting unit according to the invention can be an LED light source.

In a further advantageous embodiment variant, in a lighting unit according to the invention, the at least one light source can be a laser light source.

In the scope of the invention, a motor vehicle headlight with at least one lighting unit according to the invention can also be specified.

All of the aforementioned advantages and advantageous effects of a lighting unit according to the invention also apply mutatis mutandis to a motor vehicle headlight that is equipped with at least one lighting unit according to the invention.

Further details, features, and advantages of the invention emerge from the following explanation of the embodiments shown schematically in the drawings. In the drawings:

FIG. 1 is a sectional view from the side of a lighting unit according to the prior art, which has a first and a second reflector, the second reflector being divided into four reflector segments, each of which being associated with an aperture in the beam path between the first reflector and the second reflector;

FIGS. 2*a* to 2*d* show in each case intermediate light images of the individual reflector segments of the second reflector sketched in FIG. 1;

FIG. 2*e* illustrates the overall light image composed of the intermediate light images shown in FIGS. 2*a* to 2*d;*

FIG. 3*a* is a sectional view from the side of a lighting unit according to the invention with a first reflector constructed in two parts, the beam path being illustrated in this case in a first reflector portion of the first reflector, which first reflector portion is arranged near the aperture and associated therewith;

FIG. 3*b* is a sectional view from the side of a further, second reflector portion of the lighting unit according to the invention shown in FIG. 3*a*, the beam path of that second reflector portion being illustrated in this case in FIG. 3*b*, which portion is arranged at a greater distance from the aperture;

FIG. 4*a* shows an intermediate light image which is generated in the first reflector portion of the first reflector illustrated in FIG. 3*a* and which has a light-dark boundary;

FIGS. 4*b* to 4*d* show intermediate light images in each case, which images are generated in the second reflector portion of the multi-part first reflector illustrated in FIG. 3*b* and which are not clipped;

FIG. 4*e* illustrates the overall light image composed of the intermediate light images shown in FIGS. 4*a* to 4*d;*

FIG. 5*a* is a sectional view from the side of an alternative embodiment of the invention with a multi-part first free-form reflector, in which the aperture is attached directly to the second reflector and is associated with a first reflector portion of the first free-form reflector;

FIG. 5*b* is a sectional view from the side of a further, second reflector portion of the first free-form reflector of the lighting unit according to the invention shown in FIG. 5*a*, the beam path of that second reflector portion which is free of shadowing influence by the aperture being illustrated here in FIG. 5*b;*

Figure 1:
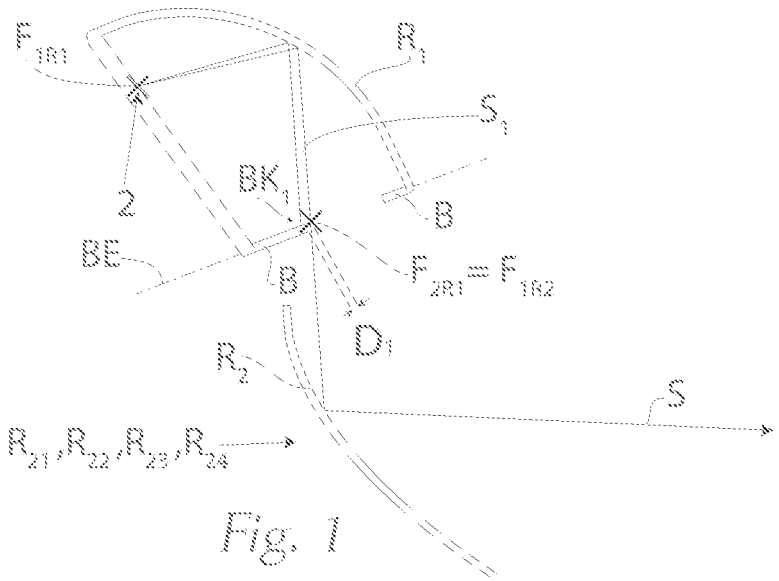

FIG. 1 schematically shows a lighting unit according to the prior art, which has a first reflector $R_1$ and a second reflector $R_2$, wherein, in a beam path S of the light symbolized by an arrow, an aperture B is provided between the first reflector $R_1$ and the second reflector $R_2$. The second reflector $R_2$ is divided in this case into four reflector segments $R_{21}$, $R_{22}$, $R_{23}$, and $R_{24}$ which are arranged horizontally next to one another and which are associated in each case with the aperture B. The first reflector $R_1$ is designed in this case, for example, as an ellipsoidal reflector and has a first focal point $F_{1R1}$ and a second focal point $F_{2R1}$. A light source 2, for example an LED light source, is located in the first focal point $F_{1R1}$. The second focal point $F_{2R1}$ of the first reflector $R_1$ is spaced at a short distance $D_1$ from an aperture edge $BK_1$ of the aperture B. The aperture B is arranged in such a way that the second focal point $F_{2R1}$ of the first reflector $R_1$ lies in its aperture plane BE. The second reflector $R_2$ used in this case is, for example, a free-form reflector, each of the reflector segments $R_{21}$, $R_{22}$, $R_{23}$, and $R_{24}$ having a focal point Fuzz in each case. These focal points $F_{1R2}$ of the second reflector $R_2$ are also arranged in the aperture plane BE. The beam $S_1$ exiting from the light source 2 and deflected by the reflector $R_1$ exits from the first reflector $R_1$ at the same small distance $D_1$ near the aperture edge $BK_1$ of the aperture B.

A disadvantage of this embodiment known from the prior art is at least that the aperture B clips each of the intermediate light images of all four reflector segments $R_{21}$, $R_{22}$, $R_{23}$, and $R_{24}$, to form light-dark boundaries. Thus, the overall efficiency of this known lighting unit—expressed as the quotient of the luminous flux used to the luminous flux exiting (in each case specified in lumens [lm])—is disadvantageously reduced.

The illustrations FIGS. 2*a* to 2*d* show in sequence the respective intermediate light images of the individual reflector segments $R_{21}$, $R_{22}$, $R_{23}$, and $R_{24}$ of the second reflector $R_2$ sketched in FIG. 1. Due to the different geometries, each of the reflector segments $R_{21}$, $R_{22}$, $R_{23}$, and $R_{24}$ generates different intermediate light images, each having different distortions of the intermediate light image, the light-dark boundary created by the aperture B being both deformed and rotated in the position thereof. The individual facets or reflector segments $R_{21}$, $R_{22}$, $R_{23}$, and $R_{24}$ shift the intermediate light image generated by them to different extents in the horizontal direction.

Figure 2A:
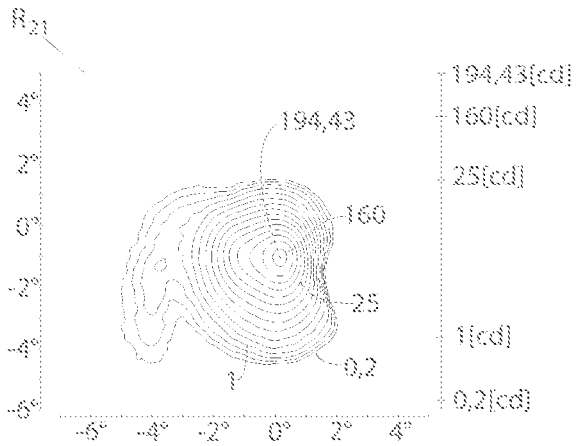
Figure 2B:
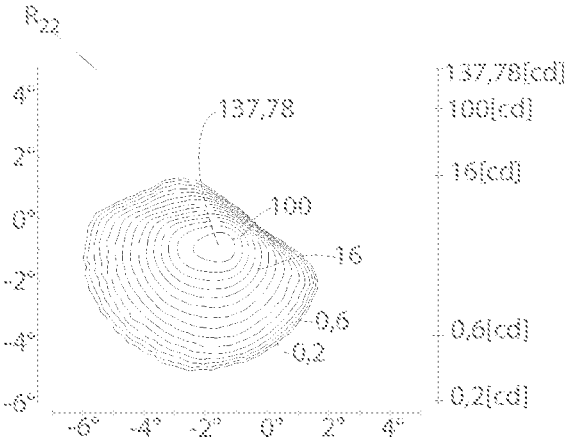
Figure 2C:
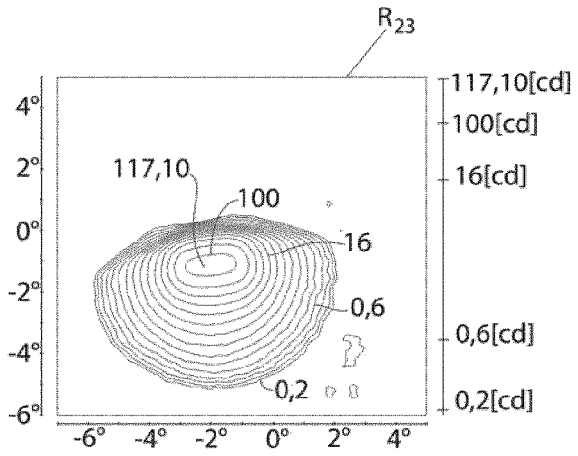
Figure 2D:
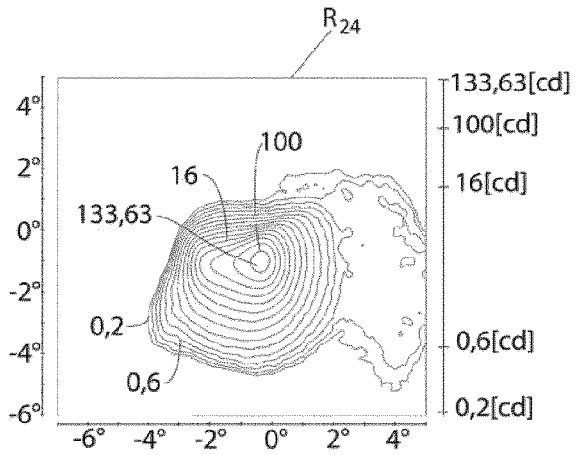
Figure 2E:
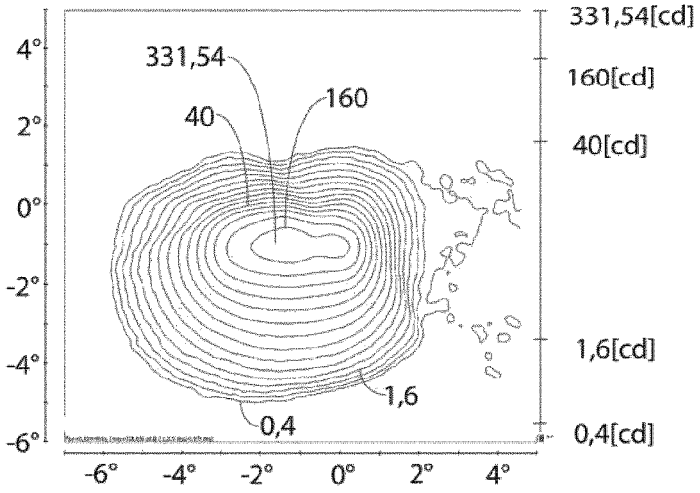

The light-dark boundary of the overall light image, which is illustrated in FIG. 2*e* as the sum of the intermediate light images shown in FIGS. 2*a* to 2*d*, is—apart from slight scattered light, which occurs in this case in the intermediate light image of the reflector segment $R_{24}$ shown in FIG. 2*d*—generated substantially by the light-dark boundary of the intermediate light image of the reflector segment $R_{21}$ shown in FIG. 2*a*.

A light image generated in this way is therefore inefficient since the light-dark boundary is only actually required in one of the four intermediate light images, namely in this case in the intermediate light image obtained in the first reflector segment $R_{21}$, whereas the light-dark boundary is required in all intermediate light images of the four reflector segments $R_{21}$, $R_{22}$, $R_{23}$, and $R_{24}$. With a total luminous flux of 100 lumens [lm] used in this case and an assumed reflectivity of the reflectors used of 0.95 or 95%, an exiting luminous flux of a total of only 53 lumens [lm] is obtained.

Figure 3A:
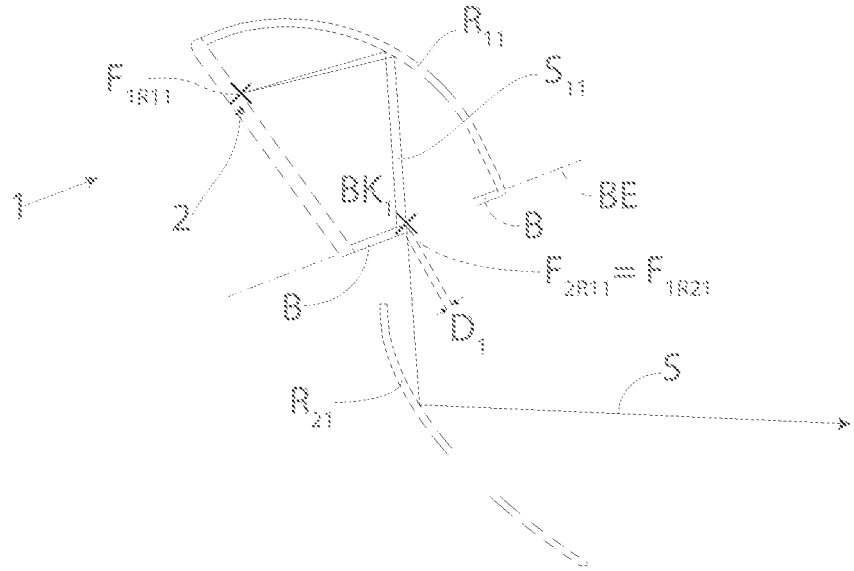

FIG. 3*a* shows a lighting unit 1 according to the invention having a two-part first reflector $R_1$ having a first reflector portion $R_{11}$ and a second reflector portion $R_{12}$, the beam path S of the first reflector portion $R_{11}$ of the first reflector $R_1$ being illustrated in this case in FIG. 3*a*. This first reflector portion $R_{11}$ is arranged near the aperture B and is associated therewith. The aperture B is provided in the beam path S between the first reflector $R_1$ and the second reflector $R_2$. The second reflector $R_2$ is divided in this case, for example, into four reflector segments $R_{21}$, $R_{22}$, $R_{23}$, and $R_{24}$ is arranged approximately horizontally next to one another, only the first reflector segment $R_{21}$ being associated with the aperture B. The two reflector portions $R_{11}$ and $R_{12}$ of the first reflector $R_1$ are designed in each case as ellipsoidal reflectors and each have a first focal point $F_{1R11}$ or $F_{1R12}$ and a second focal point $F_{2R11}$ or $F_{2R12}$. A light source 2, for example an LED light source, is located in the first focal point $F_{1R11}$ or $F_{1R12}$ of the two reflector portions $R_{11}$ and $R_{12}$.

Figure 3B:
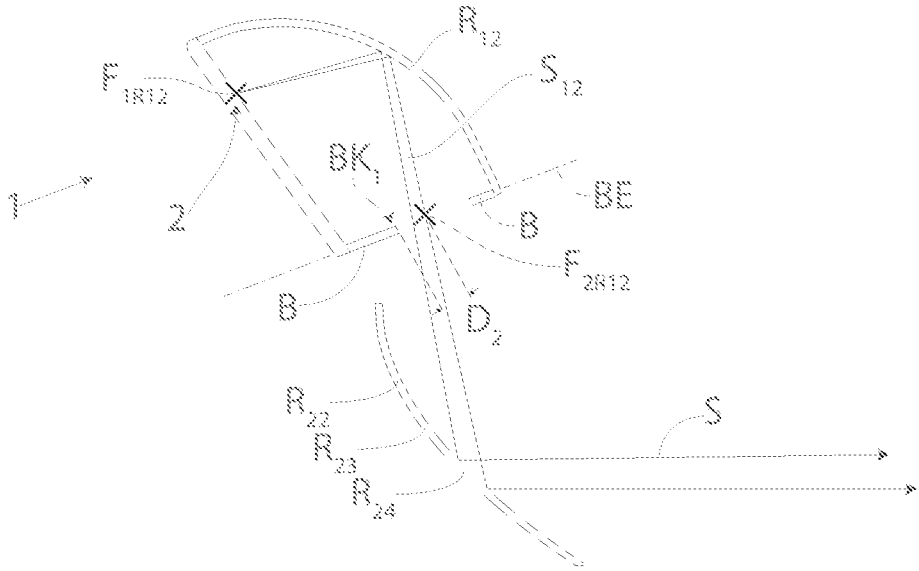

FIG. 3*b* shows the beam path S in the second reflector portion $R_{12}$ of the first reflector $R_1$ for the lighting unit 1 according to the invention shown in FIG. 3*a*.

As can be seen from FIG. 3*a*, the second focal point $F_{2R11}$ of the first reflector portion $R_{11}$ is spaced at a short distance $D_1$ from an aperture edge $BK_1$ of the aperture B, wherein the beam $S_{11}$ exiting from the light source 2 and deflected by the first reflector portion $R_{11}$ exits from the first reflector $R_1$ at this small distance $D_1$ near the aperture edge $BK_1$ of the aperture B. The aperture B thereby clips the intermediate light image generated in the first reflector portion $R_{11}$, to form a light-dark boundary. This clipped intermediate light image is illustrated in FIG. 4*a*.

As illustrated in FIG. 3*b*, the second focal point $F_{2R12}$ of the second reflector portion $R_{12}$ of the first reflector $R_1$ is spaced at a greater distance $D_2$ away from an aperture edge $BK_1$ of the aperture B. The smaller distance $D_1$ of the second focal point $F_{2R11}$ of the first reflector portion $R_{11}$ from the aperture edge $BK_1$ is in any case smaller than the greater distance $D_2$ of the second focal point $F_{2R12}$ of the second reflector portion $R_{12}$ from the aperture edge $BK_1$. The aperture B is arranged in such a way that the second focal point $F_{2R11}$ of the first reflector portion $R_{11}$ and the second focal point $F_{2R12}$ of the second reflector portion $R_{12}$ lie in each case in the aperture plane BE of the aperture B.

The second reflector $R_2$ used in this case is, for example, a free-form reflector, each of the four reflector segments $R_{21}$, $R_{22}$, $R_{23}$, and $R_{24}$ having a focal point $F_{1R21}$, $F_{1R22}$, $F_{1R23}$, or $F_{1R24}$ in each case. These focal points $F_{1R21}$, $F_{1R22}$, $F_{1R23}$, and $F_{1R24}$ of the four reflector segments $R_{21}$, $R_{22}$, $R_{23}$ and, $R_{24}$ of the second reflector $R_2$ are also arranged in the aperture plane BE.

Figure 4A:
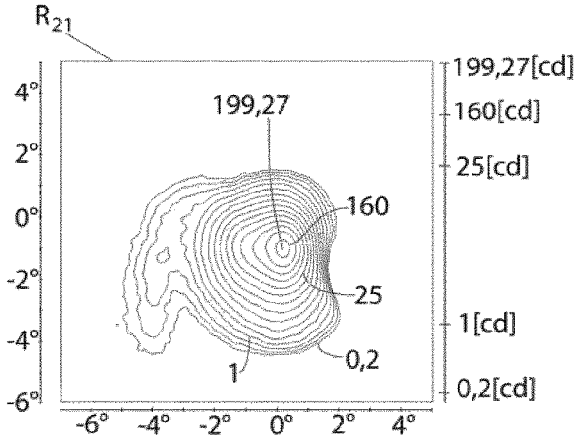

The first reflector segment $R_{21}$ of the second reflector $R_2$ is associated with the intermediate light image generated in the first reflector portion Rn of the first reflector $R_1$, this intermediate light image being shown in FIG. 4*a*.

Figure 4B:
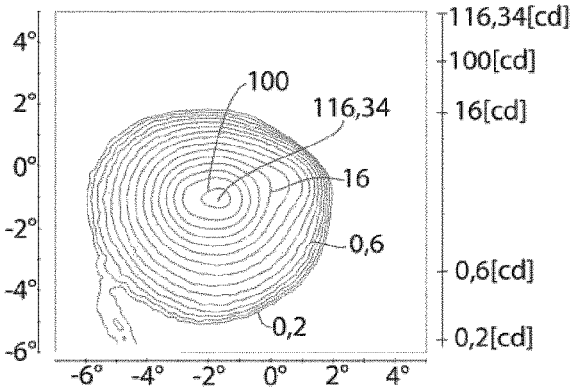
Figure 4C:
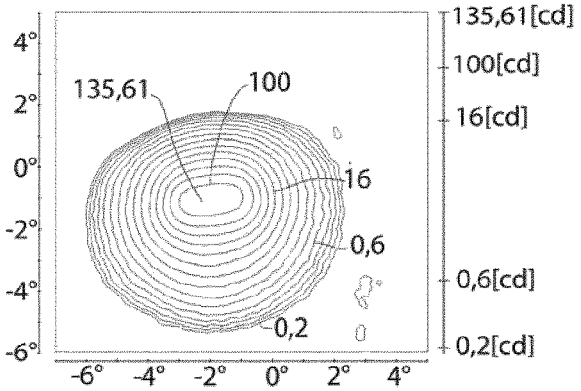
Figure 4D:
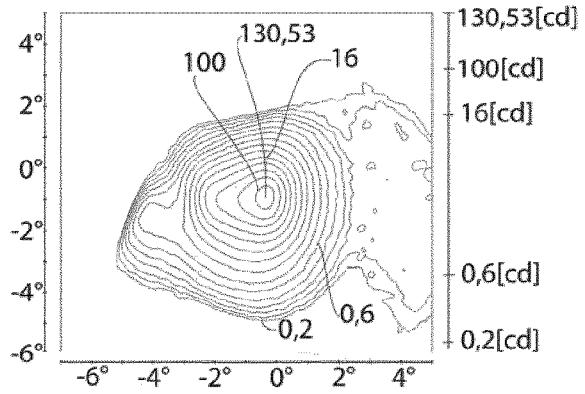

The further reflector segments $R_{22}$, $R_{23}$, and $R_{24}$ of the second reflector $R_2$ are associated with the second reflector portion $R_{12}$ of the first reflector $R_1$. The corresponding intermediate light images of the second, third, and fourth reflector segments $R_{22}$, $R_{23}$, and $R_{24}$ are shown in the illustrations FIG. 4*b* to FIG. 4*d*. Since the aperture B is arranged at a greater distance $D_2$ away from the beam $S_{12}$ emitted from the second reflector portion $R_{12}$, the intermediate light images of the second, third, and fourth reflector segment $R_{22}$, $R_{23}$ $R_{24}$ are substantially free of influence of shadowing of the aperture arrangement.

Figure 4E:
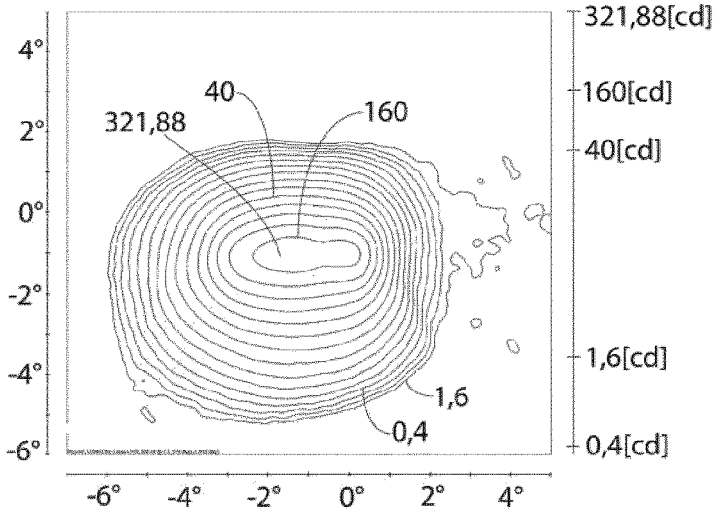

For this purpose, FIG. 4*e* shows the overall light image as the sum of the intermediate light images shown in FIGS. 4*a* to 4*d*. Since the aperture B only acts on the intermediate light image that is obtained from the pairing of the first reflector portion $R_{11}$ of the first reflector $R_1$ and the first reflector segment $R_{21}$ of the second reflector $R_2$ associated therewith, the light-dark boundary of the overall light image is generated only in the first reflector segment $R_{21}$ of the second reflector $R_2$. The other intermediate light images obtained from the second, third, and fourth reflector segments $R_{22}$, $R_{23}$, and $R_{24}$ are advantageously not shadowed or clipped, since the distance $D_2$ of the aperture B from the second focal point $F_{2R12}$ of the second reflector portion $R_{12}$ of the first reflector $R_1$ is further away compared to the small distance $D_1$ and therefore the intermediate light images of the reflector segments $R_{22}$, $R_{23}$, and $R_{24}$ are substantially free of shadowing influences.

In the overall light image of the lighting unit 1 according to the invention shown in FIG. 4*e*, with a total luminous flux of 100 lumens [lm] used and an assumed reflectivity of the reflectors used of 0.95 or 95%, an exiting luminous flux of a total of 62 lumens [lm] is obtained.

In comparison to the above-mentioned example according to FIG. 1 known from the prior art, in the case of a lighting unit 1 according to the invention having a two-part first reflector having the two reflector portions $R_{11}$, $R_{12}$ according to the illustrations FIGS. 3*a* and 3*b*, this results particularly advantageously in an increase in the efficiency of the luminous flux—starting from 53 lumens [lm] with the light distribution known from the prior art as shown in FIG. 2*e*—to 62 lumens [lm] according to the light distribution according to the invention as illustrated in FIG. 4*a*. This corresponds to an absolute increase in efficiency of 9 lumens [lm] or a relative increase in overall efficiency of around 17%.

Figure 5A:
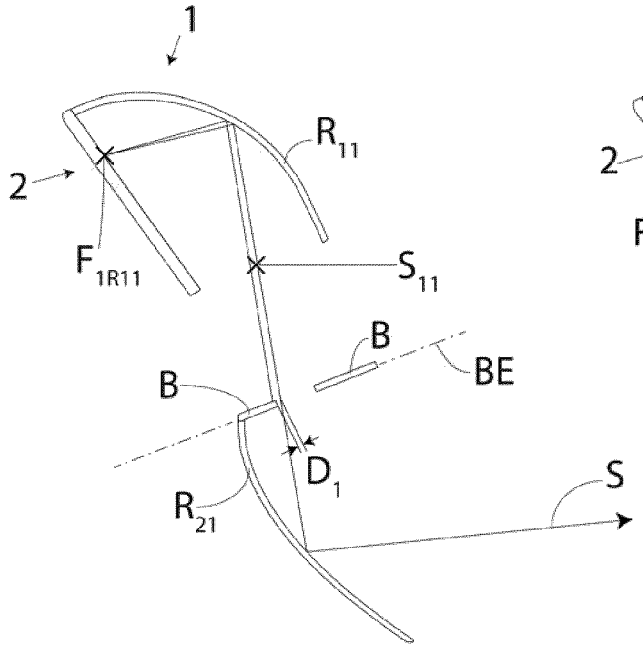
Figure 5B:
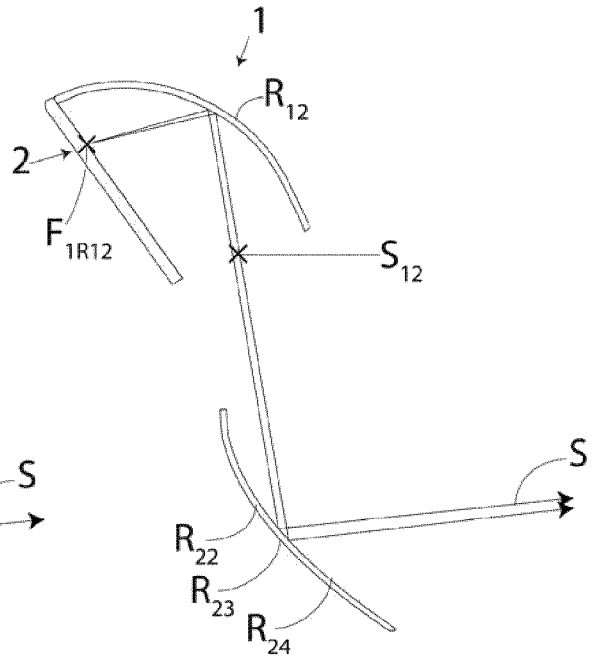

The two illustrations FIG. 5*a* and FIG. 5*b* each relate to an alternative embodiment of the invention and each show a lighting unit 1 with a multi-part first reflector $R_1$, which is designed here as a two-part free-form reflector. For this purpose, the reflector $R_1$ has a first reflector portion $R_{11}$ with a focal point $F_{1R11}$, the aperture B being arranged at a distance $D_1$ near the beam $S_{11}$ emitted from the first reflector portion $R_{11}$. The aperture B clips the intermediate light image generated in the first reflector portion $R_{11}$, to form a light-dark boundary.

The second reflector $R_2$ is segmented in this case, for example, into four reflector segments $R_{21}$, $R_{22}$, $R_{23}$, and $R_{24}$ arranged next to one another. The aperture B is attached in this case directly to the second reflector $R_2$ on its first reflector segment $R_{21}$ and is only associated with the first reflector portion $R_{11}$ of the first free-form reflector. Furthermore, only the first reflector segment $R_{21}$ of the second reflector $R_2$ is associated in this case with the intermediate light image generated in the first reflector portion $R_{11}$ of the first reflector $R_1$. This is shown in FIG. 5*a*.

FIG. 5*b* shows a further, second reflector portion $R_{12}$ of the first free-form reflector of the lighting unit according to the invention shown in FIG. 5*a*, the beam path S of the second reflector portion $R_{12}$ which is free of shadowing influence by the aperture B being illustrated here in FIG. 5*b*. The second, third, and fourth reflector segments $R_{22}$, $R_{23}$, and $R_{24}$ of the second reflector $R_2$ are associated with the intermediate light image generated in the second reflector portion $R_{12}$ of the first reflector $R_1$. These intermediate light images are advantageously not clipped or shadowed because of the lack of an aperture.

Figure 6:
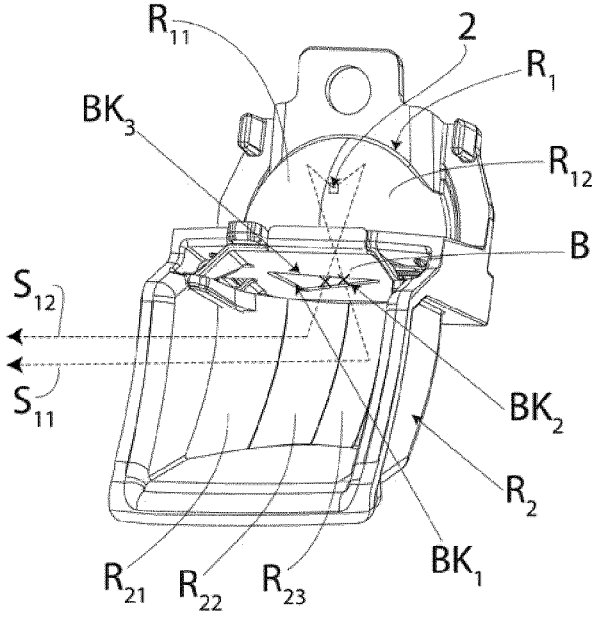
FIG. 6 is an isometric view obliquely from the front of a lighting unit according to the invention.

FIG. 6 is a detailed view of a lighting unit 1 according to the invention. In the image shown above, the lighting unit 1 comprises a light source 2 which is positioned behind or below the first reflector $R_1$. The reflector $R_1$ is constructed in one piece in this case and has two reflector portions $R_{11}$ and $R_{12}$. Dashed arrows indicate a first beam $S_{11}$ of the light exiting from the first reflector portion $R_{11}$ and a second beam $S_{12}$ of the light exiting from the second reflector portion $R_{12}$. The aperture B between the first reflector $R_1$ and the second reflector $R_2$ has a triangular aperture with three aperture edges $BK_1$, $BK_2$, and $BK_3$, the aperture edges forming the three sides of the triangular aperture.

The aperture B is positioned in such a way that a first aperture edge $BK_1$ of the aperture B is optically not active in this case and is arranged somewhat at a distance away from the first beam $S_{11}$ and from the second beam $S_{12}$. A second aperture edge $BK_2$ and a third aperture edge $BK_3$ of the aperture B are optically active in this case. The first beam $S_{11}$ is focused in this case near the optically active aperture edge $BK_3$. The second beam $S_{12}$ is focused near the optically active aperture edge $BK_2$.

This allows that (i) only the intermediate light image generated in the third reflector portion $R_{11}$ is clipped by the optically active first aperture edge $BK_3$ to form a light-dark boundary, and (ii) only the intermediate light image generated in the second reflector portion $R_{12}$ is clipped by the optically active second aperture edge $BK_2$ to form a light-dark boundary.

The intermediate light image generated in the first reflector portion $R_{11}$ remains substantially free of influence of shadowing of the aperture edge $BK_2$. The intermediate light image generated in the second reflector portion $R_{12}$ remains substantially free of influence of shadowing of the aperture edge $BK_3$.

The second reflector $R_2$ is segmented in this case, for example, into a plurality of reflector segments, with three reflector segments $R_{21}$, $R_{22}$, and $R_{23}$ arranged next to one another being considered in more detail for the following description. Only the first reflector segment $R_{21}$ of the second reflector $R_2$ is associated in this case with the intermediate light image generated in the first reflector portion $R_{11}$ of the first reflector $R_1$. The intermediate light images generated in the second and third reflector segments $R_{22}$, $R_{23}$ are advantageously not clipped, which increases the overall efficiency of the lighting unit 1 shown.

The aperture B shown in this case also has a further, second aperture edge $BK_2$, which, analogously to the preceding description, can in turn serve for selective shadowing of the intermediate light image of a further reflector segment of the second reflector $R_2$.

Figure 7:
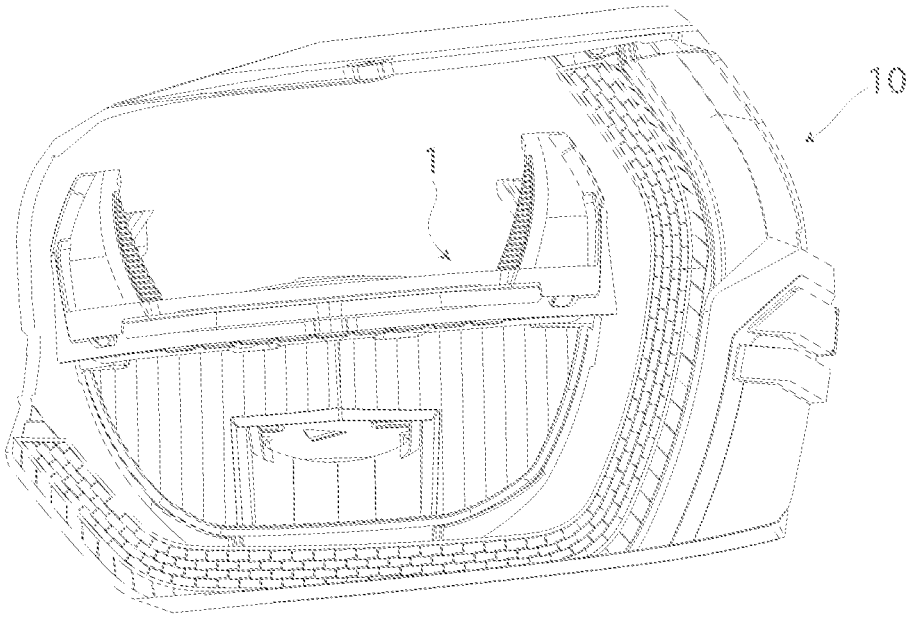
FIG. 7 is an isometric view at an angle from the front of a detail of a motor vehicle headlight with the lighting unit according to the invention shown in FIG. 6.

FIG. 7 is a detailed view of a motor vehicle headlight 10 with the lighting unit 1 according to the invention shown in FIG. 6. The lighting unit 1 is already in the installed position within the motor vehicle headlight 1 and is installed with the corresponding housing components of the headlight. A diffusing screen, which merely serves to protect the motor vehicle headlight 1 and which has no optical function, has been removed in this case in the view of FIG. 7 for a better overview and is not shown.

Figure 8:
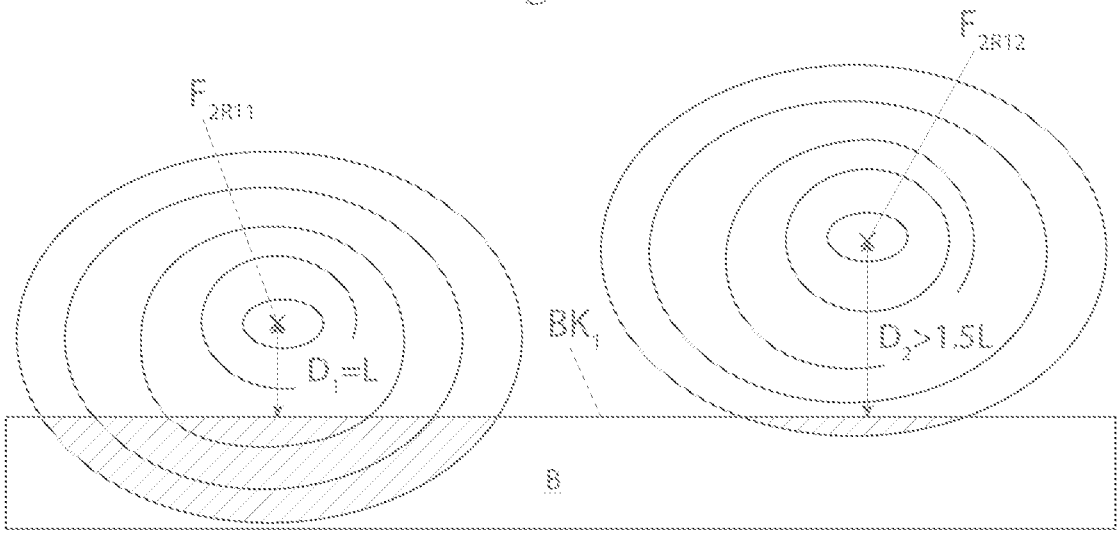
FIG. 8 is a schematic comparison on the left in the image of an aperture arrangement near the intermediate light image generated by the first reflector portion having a shadowed light-dark boundary, and, in the right half of the image, a generated intermediate light image which is substantially free of influence of shadowing of the aperture arrangement.

FIG. 8 is a schematic comparison of an aperture arrangement of a first reflector constructed in two parts, for example an ellipsoidal reflector, according to the invention. On the left in the picture, an intermediate light image generated by the first reflector portion $R_{11}$ with a shadowed light-dark boundary is illustrated. The aperture edge $BK_1$ is arranged in this case at a small distance $D_1$ near the second focal point $F_{2R11}$ of the first reflector portion $R_{11}$. This distance $D_1$ is selected to be equal to a reference length L. The reference length L, which can be used to assess or categorize the distance between the corresponding beam and the aperture B or—as is the case here—for an ellipsoid reflector between the second focal point $F_{2R11}$ of the first reflector portion $R_{11}$ the first reflector $R_1$ and the aperture B, is determined as follows:

For all reflector portions $R_{11}$, $R_{12}$, $R_{1N}$ of the first reflector $R_1$, the distance between the maximum of the illuminance $E_{MAX}$ and the aperture edge of the aperture is measured;

the smallest of these measured distances is selected as the reference length L.

The loss of luminous flux of the aperture arrangement shown in the left half of FIG. 8 is over 15% in this case.

In the right half of FIG. 8, an aperture arrangement is shown, the distance between the aperture edge $BK_1$ of the aperture B and the second focal point $F_{2R12}$ of the second reflector portion $R_{12}$ being arranged at a greater distance $D_2$ from the aperture. The distance $D_2$ in this case is greater than one and a half times the value of the reference length L. The intermediate light image generated is, by definition, substantially free of influence of shadowing of the aperture arrangement. The loss of luminous flux of the aperture arrangement shown in the right half of FIG. 8 is below 7% in this case.

Figure 9:
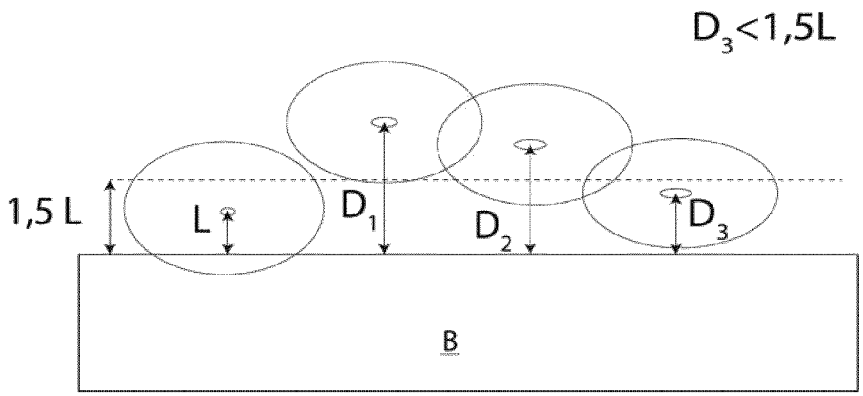
FIG. 9 is a schematic representation of a plurality of intermediate light images arranged at different distances away from an aperture.

FIG. 9 is a schematic representation of a plurality of intermediate light images spaced at different distances from an aperture B or from its aperture edge $BK_1$. The maximum illuminance of each individual intermediate light image has a specific minimum distance from the aperture or from the aperture edge, the shortest of these distances being defined as the reference length L. By definition, an intermediate light image is precisely near the aperture edge when the smallest distance of the maximum of the illuminance of the intermediate light image from the aperture edge exceeds a specified value.

As an example, 1.5 times the value of the reference length L is shown as a dashed line in FIG. 9 as the limit value. In FIG. 9, the two middle intermediate light images shown are positioned away from the aperture edge by definition since their distances $D_1$ and $D_2$ are greater than the limit value given in this case of 1.5 times the reference length L. The outer left intermediate light image is by definition near the aperture edge, since it is at a distance according to the reference length L from the aperture edge of the aperture B. Likewise, the outer right intermediate light image shown in FIG. 9 is only at a small distance $D_3$ away from the aperture B and is therefore near the aperture edge.

Figure 10:
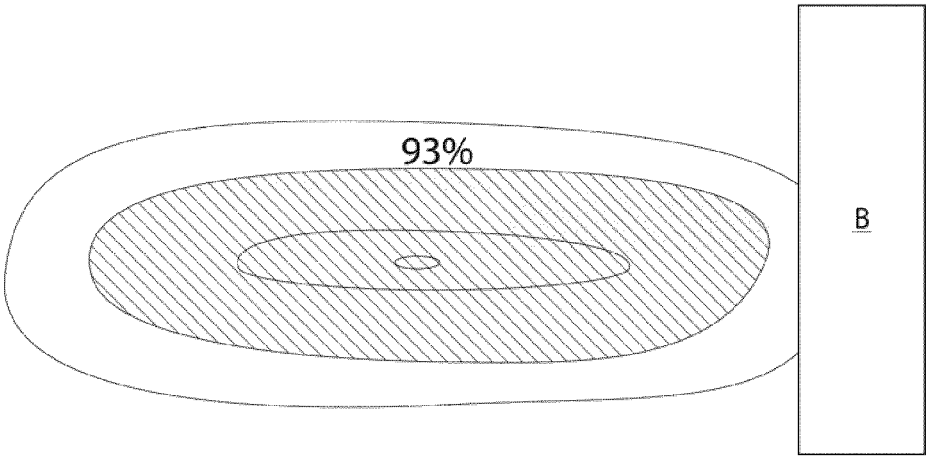
FIG. 10 is a schematic representation of an intermediate light image which is substantially free of influence of shadowing by the aperture arrangement.

FIG. 10 is a schematic representation of an intermediate light image which is substantially free of influence of shadowing by the aperture arrangement of the aperture B. The hatched region labeled 93% is limited by the isoline within which 93% of the luminous flux of the intermediate light image is located. The non-hatched outer region of the intermediate light image thus represents that edge region of the light image through which 7% of the luminous flux flows. By introducing the aperture B into the beam path, the luminous flux of the intermediate light image generated is reduced by less than 7% in this case.

LIST OF REFERENCE SIGNS

1 Lighting unit
2 Light source
10 Motor vehicle headlight
B Aperture
BE Aperture plane
$BK_1$ (First) aperture edge of the aperture
$BK_2$ Second aperture edge of the aperture
$D_1$ Distance of the aperture from the beam of the first reflector portion
$D_2$ Distance of the aperture from the beam of the second reflector portion
$D_N$ Distance of the aperture from the beam of the third or further reflector portion
$E_{MAX}$ Maximum illuminance
$F_{1R1}$ (First) focal point of the first reflector
$F_{1R11}$ (First) focal point of the first reflector portion of the first reflector
$F_{1R12}$ (First) focal point of the second reflector portion of the first reflector
$F_{1R1N}$ (First) focal point of the third or further reflector portion of the first reflector
$F_{2R1}$ Second focal point of the first reflector
$F_{2R11}$ Second focal point of the first reflector portion of the first reflector
$F_{2R12}$ Second focal point of the second reflector portion of the first reflector
$F_{2R1N}$ Second focal point of the third or further reflector portion of the first reflector
$F_{1R2}$ (First) focal point of the second reflector
$F_{1R21}$ (First) focal point of the first reflector segment of the second reflector
$F_{1R22}$ (First) focal point of the second reflector segment of the second reflector
$F_{1R2N}$ (First) focal point of the third or further reflector segment of the second reflector
FE Focal plane of the (first) focal point of the first reflector segment of the second reflector
L Reference length
$R_1$ First reflector
$R_{11}$ First reflector portion of the first reflector
$R_{12}$ Second reflector portion of the first reflector
$R_{1N}$ Third or further reflector portion of the first reflector

LIST OF REFERENCE SIGNS (CONTINUED)

$R_2$ Second reflector
$R_{21}$ First reflector segment of the second reflector
$R_{22}$ Second reflector segment of the second reflector
$R_{2N}$ Third or further reflector segment of the second reflector
S Beam path
$S_1$ Beam from the first reflector
$S_{11}$ Beam of the first reflector portion of the first reflector $S_{12}$ Beam of the second reflector portion of the first reflector $S_{1N}$ Beam of the third or further reflector portion of the first reflector

The invention claimed is:

1. A lighting unit for a motor vehicle headlight for generating a light distribution with a light-dark boundary, the lighting unit (1) comprising:

at least one light source (2);

at least one first reflector ($R_1$) having at least one focal point ($F_{1R1}$), wherein the at least one light source (2) is arranged in the at least one focal point ($F_{1R1}$);

at least one second reflector ($R_2$) having at least one focal point ($F_{1R2}$), wherein the at least one first reflector ($R_1$) is configured to emit and forward light to the at least one second reflector ($R_2$) and wherein the at least one second reflector ($R_2$) is arranged downstream of the at least one first reflector ($R_1$) in a beam path (S) and is configured to display an intermediate light image generated by the first reflector ($R_1$); and at least one aperture (B) which is arranged in the beam path (S) between the at least one first reflector ($R_1$) and the at least second reflector ($R_2$), wherein:

the first reflector ($R_1$) is constructed in at least two parts ($R_{11}$, $R_{12}$) and has a first reflector portion ($R_{11}$) and at least one separate second reflector portion ($R_{12}$), each reflector portion ($R_{11}$, $R_{12}$) having at least one focal point ($F_{1R11}$, $F_{1R12}$) in each case, at least one focal point ($F_{1R11}$, $F_{1R12}$) of the first and the at least second reflector portion ($R_{11}$, $R_{12}$) is arranged in each case congruently at the location of the at least one light source (2), the at least two part first reflector ($R_{11}$, $R_{12}$) is configured to split the beam ($S_1$) exiting from the at least one light source (2) into at least two separate beams ($S_{11}$, $S_{12}$), the at least one aperture (B) is arranged in such a way that it is associated with the first reflector portion ($R_{11}$) of the first reflector ($R_1$) and is arranged at a small distance ($D_1$) near the beam ($S_{11}$) emitted from the first reflector portion ($R_{11}$), and clips the intermediate light image generated in the first reflector portion ($R_{11}$) to form a light-dark boundary, and the at least one aperture (B) is arranged at a greater distance ($D_2$) away from the beam ($S_{12}$) emitted from the at least second reflector portion ($R_{12}$) and the intermediate light image generated in the second reflector portion ($R_{12}$) is substantially free of influence of shadowing of the aperture arrangement.

2. The lighting unit (1) according to claim 1, wherein:

the first reflector ($R_1$) is constructed in a plurality of parts and has a plurality of reflector portions ($R_{11}$, $R_{12}$) having at least one focal point ($F_{1R11}$, $F_{1R12}$), the at least one light source (2) being arranged in each case in the at least one focal point ($F_{1R11}$, $F_{1R12}$), the at least one aperture (B) being arranged in such a way that it is exclusively associated with the first reflector portion ($R_{11}$) of the first reflector ($R_1$) and is arranged at a small distance ($D_1$) near the beam ($S_{11}$) emitted from the first reflector portion ($R_{11}$), and clips the intermediate light image generated in the first reflector portion ($R_{11}$) to form a light-dark boundary, and the at least one aperture (B) being arranged at a greater distance ($D_2$) away from the beams ($S_{12}$) emitted from the second ($R_{12}$) and optionally from further reflector portions of the first reflector ($R_1$) at a distance and the intermediate light images generated in the second and optionally the further reflector portions ($R_{12}$) being substantially free of influence of shadowing of the aperture arrangement.

3. The lighting unit (1) according to claim 2, wherein the second reflector ($R_2$) is divided into two or more reflector segments ($R_{21}$, $R_{22}$) in a facet-like manner, precisely the first reflector segment ($R_{21}$) of the second reflector ($R_2$) being associated with the intermediate light image generated in the first reflector portion ($R_{11}$) of the first reflector ($R_1$).

4. The lighting unit (1) according to claim 1, wherein the second reflector ($R_2$) is divided into two or more reflector segments ($R_{21}$, $R_{22}$) in a facet-like manner, a first reflector segment ($R_{21}$) of the second reflector ($R_2$) being associated with the intermediate light image generated in the first reflector portion ($R_{11}$) of the first reflector ($R_1$).

5. The lighting unit (1) according to claim 4, wherein the at least one aperture (B) is attached directly to or at least near the first reflector segment ($R_{21}$) of the second reflector ($R_2$).

6. The lighting unit (1) according to claim 4, wherein an aperture plane (BE) of the at least one aperture (B) corresponds to a focal plane (FE) of the at least one focal point ($F_{1R21}$) of the first reflector segment ($R_{21}$) of the second reflector ($R_2$).

7. The lighting unit (1) according to claim 1, wherein the at least one aperture (B) is attached directly to or at least near the first reflector portion ($R_{12}$) of the first reflector ($R_1$).

8. The lighting unit (1) according to claim 1, wherein at least the first reflector portion ($R_{11}$) of the first reflector ($R_1$) is an ellipsoidal reflector which has a second focal point ($F_{2R11}$), the at least one aperture (B) being arranged so that it is spaced at a short distance ($D_1$) from the second focal point ($F_{2R11}$) of the first reflector portion ($R_{11}$).

9. The lighting unit (1) according to claim 1, wherein the two or more reflector portions ($R_{11}$ i, $R_{12}$) of the first reflector ($R_1$) are ellipsoidal reflectors in each case, each having a second focal point ($F_{2R11}$, $F_{2R12}$), the at least one aperture (B) being arranged such that it is arranged at a small distance ($D_1$) near the second focal point ($F_{2R11}$) of the first reflector portion ($R_{11}$) and the aperture (B) being arranged at a greater distance ($D_2$) away from the second focal points ($F_{2R12}$) of all further reflector portions ($R_{12}$) of the first reflector ($R_1$).

10. The lighting unit (1) according to claim 1, wherein the small distance ($D_1$) from the beam ($S_{11}$) and/or from the second focal point ($F_{2R11}$) of the first reflector portion ($R_{11}$) of the first reflector ($R_1$) to an aperture edge ($BK_1$) of the aperture (B) is then defined as near the aperture (B) if the distance ($D_1$) is less than 1.7 times the value of a reference length (L), and the intermediate light image generated in the first reflector portion ($R_{11}$) is clipped to form a light-dark boundary, the reference length (L) being selected as the smallest distance from the distances of the maximum illuminance ($E_{MAX}$) of all reflector portions ($R_{11}$, $R_{12}$) of the first reflector ($R_1$) to the aperture edge ($BK_1$) of the aperture (B).

11. The lighting unit of claim 10, wherein the distance ($D_1$) is less than 1.5 times the value of a reference length (L).

12. The lighting unit of claim 10, wherein the distance ($D_1$) is less than 1.3 times the value of a reference length (L).

13. The lighting unit (1) according to claim 1, wherein the greater distance ($D_2$, $D_N$) from the beam ($S_{12}$) and/or from the second focal point ($F_{2R12}$) of the second reflector portion ($R_{12}$) and further reflector portions of the first reflector ($R_1$) to an aperture edge ($BK_1$) of the aperture (B) is then defined as away from the aperture (B), if by introducing the aperture (B) in the beam path (S) the luminous flux of the intermediate light image generated in the second and optionally the further reflector portions ($R_{12}$) is reduced by at most 10%.

14. The lighting unit of claim 13, wherein the luminous flux of the intermediate light image generated in the second and optionally the further reflector portions ($R_{12}$) is reduced by at most 7%.

15. The lighting unit of claim 13, wherein the luminous flux of the intermediate light image generated in the second and optionally the further reflector portions ($R_{12}$) is reduced by at most 5%.

16. The lighting unit (1) according to claim 1, wherein the at least one aperture (B) has a first aperture edge ($BK_1$) for generating a first light-dark boundary and a second aperture edge ($BK_2$) for generating a second light-dark boundary and/or is adjustably arranged in the beam path (S) between the at least one first reflector ($R_1$) and the at least second reflector ($R_2$).

17. The lighting unit (1) according to claim 1, wherein the at least one light source (2) is an LED light source.

18. The lighting unit (1) according to claim 1, wherein the at least one light source (2) is a laser light source.

19. A motor vehicle headlight (10) having at least one lighting unit (1) according to claim 1.

* * * * *